US005376015A

United States Patent [19]

Fuchs et al.

[11] Patent Number: 5,376,015

[45] Date of Patent: Dec. 27, 1994

[54] SCREW-ON ELECTRICAL CONNECTOR ASSEMBLY

[75] Inventors: Helmut Fuchs, Halver; Michael Richter, Lüdenscheid, both of Germany

[73] Assignee: Karl Lomberg GmbH & Co., Schalksmuhle, Germany

[21] Appl. No.: 21,950

[22] Filed: Feb. 23, 1993

[30] Foreign Application Priority Data

Feb. 22, 1992 [DE] Germany ..... 4205440

[51] Int. Cl.[5] ..... H01R 4/38

[52] U.S. Cl. ..... 439/321; 439/312

[58] Field of Search ..... 439/312, 313, 313.1, 439/315, 320, 321; 285/82, 87, 88, 89

[56] References Cited

U.S. PATENT DOCUMENTS

| | | | |
|---|---|---|---|
| 3,633,944 | 1/1972 | Hamburg | 439/321 X |
| 3,742,427 | 6/1973 | Ballard | 439/320 X |
| 4,239,314 | 12/1980 | Anderson . | |
| 4,359,255 | 11/1982 | Gallusser et al. | 439/316 |
| 4,477,022 | 10/1984 | Shuey et al. | 439/314 X |
| 4,548,458 | 10/1985 | Gallusser et al. | 439/312 |
| 4,708,663 | 11/1987 | Eckart | 439/469 |
| 4,984,995 | 1/1991 | Tucker et al. | 439/321 |

FOREIGN PATENT DOCUMENTS

| | | |
|---|---|---|
| 2136500 | 7/1971 | Germany . |
| 2840728 | 9/1978 | Germany . |
| 3209734 | 3/1982 | Germany . |
| 3625134 | 7/1986 | Germany . |

*Primary Examiner*—Khiem Nguyen

*Attorney, Agent, or Firm*—Herbert Dubno; Andrew Wilford

[57] ABSTRACT

An electrical connector assembly has a threaded part having a conductor, an unthreaded part having a conductor, fittable along an axis with the threaded part for engagement of the conductors with each other, and formed with front and back axially spaced stops, and an internally threaded nut axially displaceable on the unthreaded part between the stops through a predetermined axial distance, rotatable about the axis on the unthreaded part, and threadedly engageable with the threaded part to lock the parts axially together with the nut engaging the front stop. The nut is formed with at least one axially extending and radially projecting tooth, the unthreaded part is formed with at least one axially extending and radially projecting tooth, and the teeth are so positioned that they come into engagement with each other only during a small fraction of the displacement of the nut on the unthreaded part immediately prior to engagement with the front stop.

12 Claims, 1 Drawing Sheet

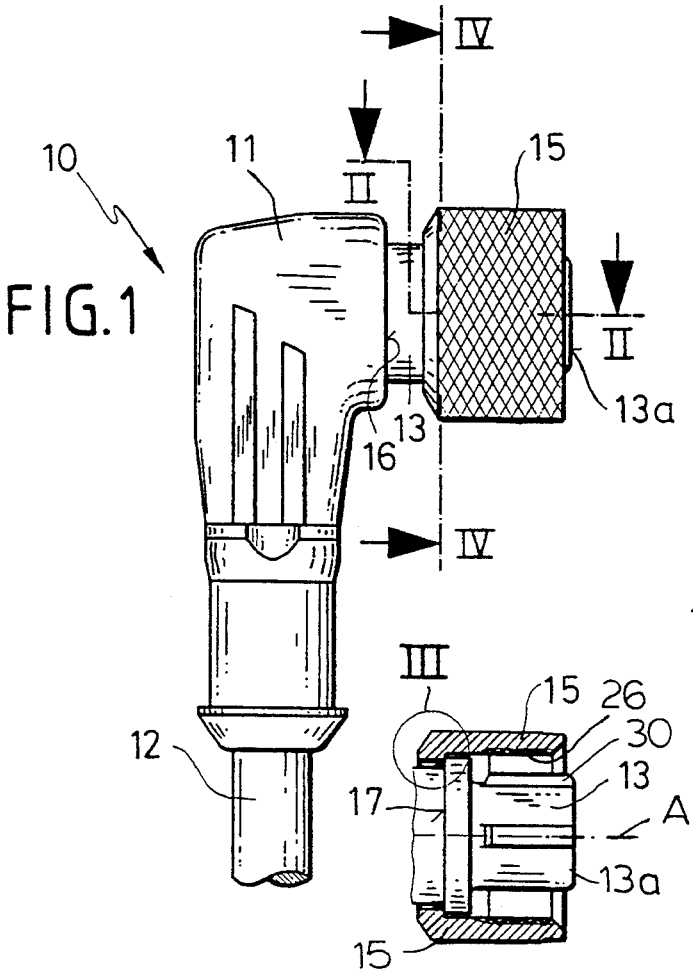
FIG.1
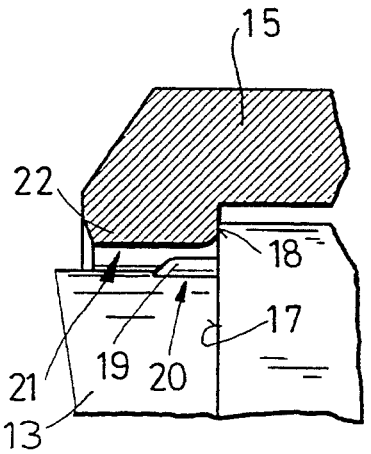
FIG. 3
FIG.2
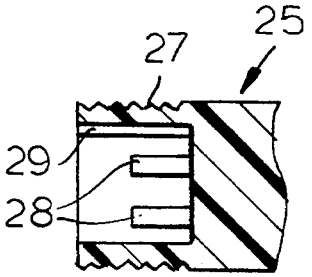
FIG.6
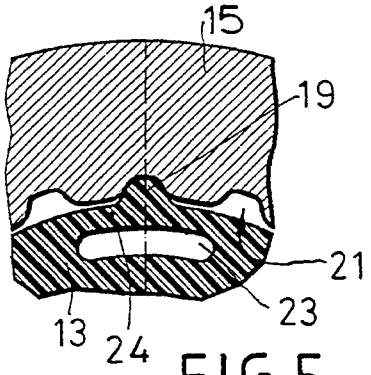
FIG.5
FIG. 4
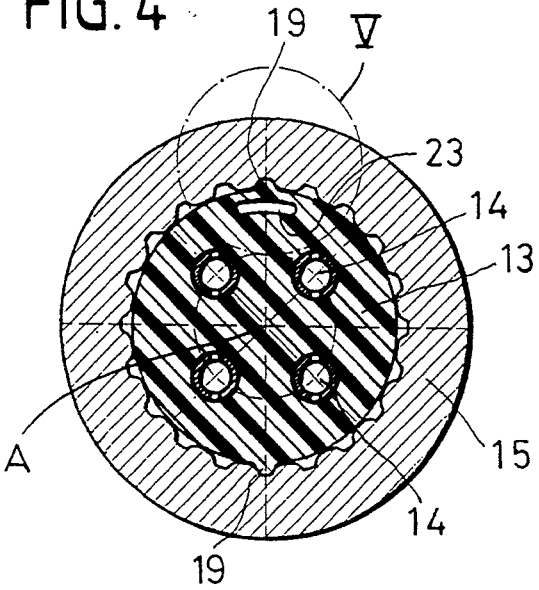

SCREW-ON ELECTRICAL CONNECTOR ASSEMBLY

FIELD OF THE INVENTION

The present invention relates to an electrical connector assembly consisting of a plug and socket. More particularly this invention concerns such an assembly which is screwed together to make the connection.

BACKGROUND OF THE INVENTION

An electrical connector assembly, for instance to connect a cable to a proximity switch such as described in copending patent application Ser. No. 07/854,411 filed Mar. 19, 1992 (now U.S. Pat. No. 5,209,669), has a threaded part having a conductor, an unthreaded part normally mounted on a cable, and a nut on the unthreaded part. This unthreaded part has a conductor, is fittable along an axis with the threaded part for engagement of the conductors with each other, and is formed with front and back axially spaced stops. The nut is axially displaceable on the unthreaded part between the stops through a predetermined axial distance, is rotatable about the axis on the unthreaded part, and is threadedly engageable with the threaded part to lock the parts axially together with the nut engaging the front stop. Thus to make the electrical connection the two parts are fitted together to engage their conductors with each other, and then the nut is screwed down to prevent them from pulling axially apart.

This system can loosen by unscrewing of the nut when it is vibrated. Accordingly German patent document 2,136,500 filed Jul. 21, 1971 by G. Spinner et al provides axially projecting teeth on the front end of the nut and on the threaded part an axially displaceable ring that is formed with axially projecting teeth and that also is prevented from rotating on the threaded part. Thus this ring is retracted against the force of a spring as the nut is screwed down, then is released so the spring presses its teeth into the teeth of the nut, preventing same from rotating. Such a system is expensive to manufacture due to the provision of several extra moving parts and is somewhat cumbersome to use.

German patent document 2,840,728 filed Sep. 19, 1978 by G. Spinner proposes a similar system where the axially displaceable toothed ring is carried on the nut, and the threaded part is itself unitarily formed with a ring of sawtooth-shaped teeth engageable with the teeth of the ring. This arrangement is merely a kinematic rearrangement of the parts of the other above-described system giving no significant advantages.

In German patent 3,209,734 filed Mar. 17, 1982 by A. Stieler the separate axially movable ring is dispensed with, and instead the threaded part is provided with one or more axially projecting but also axially deflectable teeth. While this does cut down on the complexity of the parts somewhat, it still is a fairly complicated structure.

German patent 3,625,134 filed Jul. 25, 1986 proposes such a system where the teeth are radially deflectable, but must be ratcheted during the entire axial travel of the nut. Furthermore its structure is fairly complex.

In U.S. Pat. No. 4,239,314 of Anderson et al a fairly complex arrangement is provided to retain the two parts together. The teeth ratchet during the entire movement of the nut, and the device is, however, fairly complicated and expensive to build.

OBJECTS OF THE INVENTION

It is therefore an object of the present invention to provide an improved screw-type electrical connector assembly.

Another object is the provision of such an improved screw-type electrical connector assembly which overcomes the above-given disadvantages, that is which is of extremely simple construction so that it is inexpensive to manufacture, and that provides a solid locking of the device in its end, fully closed position while not significantly inhibiting or complicating assembly or disassembly of the connector.

SUMMARY OF THE INVENTION

An electrical connector assembly has according to the invention a threaded part having a conductor, an unthreaded part having a conductor, fittable along an axis with the threaded part for engagement of the conductors with each other, and formed with front and back axially spaced stops, and an internally threaded nut axially displaceable on the unthreaded part between the stops through a predetermined axial distance, rotatable about the axis on the unthreaded part, and threadedly engageable with the threaded part to lock the parts axially together with the nut engaging the front stop. According to the invention the nut is formed with at least one axially extending and radially projecting tooth, the unthreaded part is formed with at least one axially extending and radially projecting tooth, and the teeth are so positioned that they come into engagement with each other only during a small fraction of the displacement of the nut on the unthreaded part immediately prior to engagement with the front stop.

Thus with this system the teeth are provided wholly on the threaded part. The unthreaded part, which is frequently the element that is replaced, has none of the latching structure so its manufacturing costs are not affected by the provision of these elements. In any case the latching system is so very simple that it can be molded right into the nut and unthreaded part without increasing manufacturing costs therefor.

According to the invention the tooth on the unthreaded part has an axial length that is a small fraction of the predetermined axial displacement distance of the nut on the unthreaded part. More particularly, the tooth on the unthreaded part is adjacent the front stop and indeed extends to the front stop.

The tooth on the nut is unitary with the nut and in fact the nut is formed with an array of such teeth, in fact constituted as splines angularly equispaced about the axis.

To facilitate ease of use, the connector assembly is set up for elastic radial deflection of the one tooth. More particularly the unthreaded part is formed radially inward of the respective tooth with a void that permits the tooth to be deflected radially inward. The teeth are of generally isosceles-trapezoidal section, typically with rounded edges, not of the sawtooth shape used in the prior-art systems.

BRIEF DESCRIPTION OF THE DRAWING

The above and other objects, features, and advantages will become more readily apparent from the following, reference being made to the accompanying drawing in which:

FIG. 1 is a side view of the nut and unthreaded part of the connector assembly according to the invention;

FIG. 2 is a section taken along line II—II of FIG. 1;

FIG. 3 is a large-scale view of the detail indicated at III in FIG. 2;

FIG. 4 is a section taken along line IV—IV of FIG. 1;

FIG. 5 is a large-scale view of the detail indicated at V in FIG. 4;

FIG. 6 is an axial section through the unthreaded part of the connector assembly of this invention.

SPECIFIC DESCRIPTION

As seen in FIGS. 1 through 6 a connector assembly according to this invention includes an angle part 10 having a body 11 and tubular conductors 14 and a threaded part 25 that has pin conductors 28 and that may be part of a proximity-detector switch. In practice the two parts 10 and 25 can be fitted together along an axis A so that the four (or more or less) conductor pins 28 fit into the conductor sleeves 14 and then a nut 15 carried on the angle part 10 is rotated so its internal threading 26 engages an external threading 27 on the part 25 and the two parts 10 and 25 are solidly retained together. Interfitting axial formations 29 and 30 on the parts 10 and 25 ensure proper orientation when coupled.

The angle part 10 has the body 11 from which extends a cable 12 and a cylindrical body or stem 13 formed with a rear stop shoulder 16 and a front stop shoulder 17 between which an inwardly projecting collar 22 on the nut 15 can move axially. The collar 15 engages with a forwardly directed shoulder 18 against the rearwardly directed front stop shoulder 17 of the body 13 when in the front position illustrated in FIG. 3.

According to the invention the nut 15 and body 13 can be secured together by formations 20 to prevent them from rotating relative to each other about the axis A when the nut 15 is screwed all the way down onto the part 25, that is when the shoulder 18 is against the stop 17. To this end, the collar 22 of the nut 15 is formed with an array of splines 21 that extend the full axial length of this collar 22. The body 13 of the unthreaded part 10 is formed with at least one short axially extending ridge 19 having an axial length equal to a small fraction, here about one-fourth, of the total axial distance the nut 15 can move axially relative to the body 13. This ridge 19 is formed in accordance with the invention immediately adjacent the front stop 17. The synthetic-resin body 13 underneath it can be formed with a void 23 so that the ridge 19 can be deflected inward somewhat, as the void in effect leaves the ridge 19 on a thin wall portion 24 of the elastically deformable material of the body 13.

Thus according to the invention during the last few rotations of the nut 15 before it bottoms and reaches its end positions, the ridge 19 will engage in the splines 21, ratcheting through them as it is deflected inward. Nonetheless for much of the axial travel of the nut 15 on the body 13, there will be no such interengagement so that screwing the parts 10 and 25 together and apart will be fairly easy. As a result the formations 19 and 21 serve a double function: on the one hand they prevent the nut 15 from unscrewing if the assembly is vibrated, and on the other hand they provide a sensible and normally also audible indication that the nut 15 is screwed into its end position.

We claim:

1. In an electrical connector assembly comprising:

a threaded part having a conductor;

an unthreaded part having a conductor, fittable along an axis with the threaded part for engagement of the conductors with each other, and formed with front and back axially spaced stops; and an internally threaded nut axially displaceable on the unthreaded part between the stops through a predetermined axial travel distance, rotatable about the axis on the unthreaded part, and threadedly engageable with the threaded part to lock the parts axially together with the nut engaging the front stop and the conductors engaged with each other; the improvement wherein the nut is formed with at least one axially extending and radially projecting tooth, the unthreaded part is formed with at least one axially extending and radially projecting tooth, one of the teeth is of an axial length substantially shorter than the axial travel distance and is axially spaced from and wholly unengageable with the other of the teeth when the nut is engaged with the rear stop, and the teeth are so positioned that they come into engagement with each other only during a small fraction of the displacement of the nut on the unthreaded part immediately prior to engagement of the nut with the front stop.

2. The connector assembly defined in claim 1 wherein the tooth on the unthreaded part is the one tooth.

3. The connector assembly defined in claim 2 wherein the tooth on the unthreaded part is adjacent the front stop.

4. The connector assembly defined in claim 3 wherein the tooth on the unthreaded part extends to the front stop.

5. The connector assembly defined in claim 2 wherein the tooth of the nut is unitary with the nut.

6. The connector assembly defined in claim 5 wherein the nut is formed with an array of such teeth angularly equispaced about the axis.

7. The connector assembly defined in claim 1, further comprising means associated with one of the teeth for elastic radial deflection of the one tooth.

8. The connector assembly defined in claim 7 wherein the unthreaded part is provided with the means.

9. The connector assembly defined in claim 8 wherein the unthreaded part is formed radially inward of the respective tooth with a void constituting the means.

10. The connector assembly defined in claim 1 wherein the teeth are of generally isosceles-trapezoidal section.

11. An electrical connector assembly comprising:

a threaded part having a conductor;

an unthreaded part having a conductor, fittable along an axis with the threaded part for engagement of the conductors with each other, formed with front and back axially spaced stops, and formed with at least one radially outwardly projecting and axially relatively short tooth positioned immediately adjacent the front stop; and an internally threaded nut axially displaceable on the unthreaded part between the stops through a predetermined axial travel distance, rotatable about the axis on the unthreaded part, threadedly engageable with the threaded part to lock the parts axially together with the nut engaging the front stop, and formed with an array of inwardly projecting teeth so positioned that they come into engagement with the tooth of the unthreaded part only during a small fraction of the displacement of the nut on the unthreaded part immediately prior to engagement of the nut with the front stop.

12. An electrical connector assembly comprising:

a threaded part having a conductor;

an unthreaded part having a conductor, fittable along an axis with the threaded part for engagement of the conductors with each other, formed with front and back axially spaced stops, and formed with at least one radially outwardly projecting and axially relatively short tooth positioned immediately adjacent the front stop; and an internally threaded nut having axially opposite front and rear ends, axially displaceable on the unthreaded part between the stops through a predetermined axial travel distance between a front position with its front end engaging the front stop and a rear position with its rear end engaging the rear stop, rotatable about the axis on the unthreaded part, threadedly engageable with the threaded part to lock the parts axially together with the nut engaging the front stop and formed with an array of inwardly projecting teeth of an axial length substantially shorter than the travel distance such that in the rear position the inwardly projecting teeth are axially spaced from the outwardly projecting tooth and in the front position the inwardly projecting teeth engage the outwardly projecting tooth.

* * * * *

UNITED STATES PATENT AND TRADEMARK OFFICE

CERTIFICATE OF CORRECTION

PATENT NO. : 5,376,015
DATED : December 27, 1994
INVENTOR(S) : Fuchs, et. al.

It is certified that error appears in the above-indentified patent and that said Letters Patent is hereby corrected as shown below:

Title page, item [73], Assignee should read--Karl Lumberg GmbH & Co.,--

Signed and Sealed this

Twentieth Day of June, 1995

*Attest:*

Bruce Lehman

BRUCE LEHMAN

*Attesting Officer*

*Commissioner of Patents and Trademarks*